US009370937B2

(12) United States Patent
Kurokawa et al.

(10) Patent No.: US 9,370,937 B2
(45) Date of Patent: Jun. 21, 2016

(54) INSPECTING CHART AND PRINTING APPARATUS

(71) Applicant: SCREEN Holdings Co., Ltd., Kyoto (JP)

(72) Inventors: Yuji Kurokawa, Kyoto (JP); Takaharu Yamamoto, Kyoto (JP); Kazuyuki Tanoue, Kyoto (JP); Hiroaki Kishida, Kyoto (JP); Kunio Muraji, Kyoto (JP)

(73) Assignees: SCREEN Holdings Co., Ltd. (JP); RICOH COMPANY, LTD. (JP)

( * ) Notice: Subject to any disclaimer, the term of this patent is extended or adjusted under 35 U.S.C. 154(b) by 0 days.

(21) Appl. No.: 14/640,737

(22) Filed: Mar. 6, 2015

(65) Prior Publication Data

US 2015/0273887 A1 Oct. 1, 2015

(30) Foreign Application Priority Data

Mar. 25, 2014 (JP) ..... 2014-061963

(51) Int. Cl.

| | |
|---|---|
| ***B41J 29/38*** | (2006.01) |
| ***B41J 29/393*** | (2006.01) |
| ***B41J 2/21*** | (2006.01) |
| ***B41J 3/54*** | (2006.01) |
| ***B41J 11/00*** | (2006.01) |

(52) U.S. Cl.

CPC ..... *B41J 2/2135* (2013.01); *B41J 2/2146* (2013.01); *B41J 3/543* (2013.01); *B41J 11/008* (2013.01)

(58) Field of Classification Search

USPC ..... 347/14, 19

See application file for complete search history.

(56) References Cited

U.S. PATENT DOCUMENTS

2002/0063871 A1* 5/2002 Kinas ..... B41J 11/42 358/1.4
2010/0171781 A1* 7/2010 Cho ..... B41J 2/2135 347/14
2014/0292888 A1* 10/2014 Terada ..... B41J 29/393 347/19

FOREIGN PATENT DOCUMENTS

JP 2003-341016 12/2003
WO WO 2014/008933 A1 1/2014

OTHER PUBLICATIONS

Extended European Search Report issued Nov. 27, 2015 in corresponding European Patent Application No. 15156688.2.

* cited by examiner

*Primary Examiner* — Jason Uhlenhake
(74) *Attorney, Agent, or Firm* — Ostrolenk Faber LLP

(57) ABSTRACT

Disclosed is an inspecting chart including a reference pattern containing a first line segment group and a second line segment group, a first-side deviation pattern, and a second-side deviation pattern. The first line segment group is formed by a plurality of first line segments printed by a reference printing head at a first given interval. The second line segment is formed by second line segments printed by a printing head on a center between two adjacent first line segments or a center of each of the first line segments, the printing head being spaced away from the reference printing head in a the transportation direction of a print medium. The first-side deviation pattern and the second-side deviation pattern are printed with various deviations.

10 Claims, 9 Drawing Sheets

INSPECTING CHART AND PRINTING APPARATUS

TECHNICAL FIELD

The present invention relates to an inspecting chart for inspecting misregister that a printing position is shifted, and a printing apparatus.

BACKGROUND ART

In a printing apparatus, such as an inkjet printing apparatus with a plurality of printing heads arranged in a transportation direction of a printing sheet, transportation of the printing sheet in a skew or serpentine manner causes misregister that a printing position is shifted orthogonally to the transportation direction. Such misregister degrades a printing quality. Consequently, a challenge for the printing apparatus is to determine and correct a shift amount in the misregister.

A currently-used inkjet printing apparatus for printing in a plurality of colors adopts the following approach for determining a color misalignment amount and a correction amount of the color misalignment occurring due to the skew or serpentine transportation of the printing sheet. That is, evaluation patterns are printed on a plurality of given printing sheets successively. The patterns are visually determined partially using a magnifying glass or are determined using a special measuring instrument, whereby an average shift amount is determined and a correction amount of the shift amount is calculated. Thereafter, the inkjet printing apparatus is adjusted with the correction amount. This is typically performed. See, for example, Japanese Patent Publication No. 2003-341016A.

However, the examples of the conventional apparatus with such constructions have the following problems.

Specifically, the currently-used approach is complicated in terms of determining the correction amount. Accordingly, the approach involve a problem that much time is required for obtaining the correction amount used for correcting the misregister due to the skew or serpentine transportation.

Likewise the misregister due to the skew or serpentine transportation, the approach also involves a problem that much time is required for obtaining a correction amount used for correcting misregister in the transportation direction. Here, the misregister in the transportation direction means a deviation in discharge timing of ink droplets in an inkjet printing apparatus. Alternatively, the misregister also occurs from a variation in transportation speed of the printing sheet.

SUMMARY OF INVENTION

The present invention has been made regarding the state of the art noted above, and its one object is to provide an inspecting chart and a printing apparatus that allows simple and rapid obtainment of a correction amount.

In order to accomplish the above object, the present invention adopts the following construction.

One embodiment of the present invention discloses an inspecting chart for determining a correction value for correcting a skew or serpentine transportation of a print medium. The inspecting chart includes a reference pattern containing a first line segment group and a second line segment group, a first-side deviation pattern, and a second-side deviation pattern. The first line segment group is formed by a plurality of first line segments printed by a reference printing head on the print medium at a first given interval, the first line segments each having a first line width parallel to a transportation direction of the print medium. The second line segment is formed by second line segments printed by a printing head on a center between two adjacent first line segments or a center of each of the first line segments, the printing head being spaced away from the reference printing head in the transportation direction of the print medium, and the second line segments each having a second line width and being parallel to the first line segments. The first-side deviation pattern is spaced away from the reference pattern in a direction orthogonal to the transportation direction of the print medium, and includes the first line segment group and a second line segment group, the second line segment group being formed by the second line segments printed by a given deviation from the center between the two adjacent first line segments or the center of each of the first line segments toward a first side of the direction orthogonal to the transportation direction of the print medium. The second-side deviation pattern is spaced away from the reference pattern in the direction orthogonal to the transportation direction of the print medium opposite to the first-side deviation pattern across the reference pattern, and includes the first line segment group and a second line segment group, the second line segment group being formed by the second line segments printed by a given deviation from the center between the two adjacent first line segments or the center of each of the first line segments toward a second side of the direction orthogonal to the transportation direction of the print medium. The first-side deviation pattern and the second-side deviation pattern are printed with various deviations.

With the embodiment of the present invention, the first-side deviation pattern and the second-side deviation pattern are printed across the reference pattern. The deviation patterns are printed with various deviations. When the second line segment is printed at the center between the two adjacent first line segments with no skew or serpentine transportation, the whole of the second line segments appears as it is. Consequently, the reference pattern is recognized the darkest in terms of a visual density difference. When the second line segment is printed at the center of the first line segment, the second line segment entirely lays on the first line segment in the reference pattern. Accordingly, the reference pattern is recognized the brightest in terms of the visual density difference. In contrast to this, when a skew or a serpentine transportation occurs, the second line segment group is shifted relative to the first line segment group depending on the degree of the skew or serpentine transportation. Accordingly, the visual density difference changes, and the dark or bright pattern is shifted from the reference pattern to the first-side deviation pattern or the second-side deviation pattern. Consequently, a given deviation in the deviation pattern to be dark or bright corresponds to a correction amount. Accordingly, a correction value resulting from the skew or serpentine transportation is obtainable from the correction amount. As a result, the correction amount for correcting misregister due to the skew or serpentine transportation is obtainable simply and rapidly.

Another embodiment of the present invention discloses an inspecting chart for determining a correction value for correcting a skew or serpentine transportation of a print medium. The inspecting chart includes a reference pattern containing a first line segment group and a second line segment group, a first-side deviation pattern, and a second-side deviation pattern. The first line segment group is formed by a plurality of first line segments printed by a reference printing head on the print medium at a first given interval, the first line segments each having a first line width orthogonal to a transportation direction of the print medium. The second line segment is formed by second line segments printed by a printing head on a center between two adjacent first line segments or a center of each of the first line segments, the printing head being spaced away from the reference printing head in the transportation direction of the print medium, and the second line segments each having a second line width and being parallel to the first line segments. The first-side deviation pattern is spaced away from the reference pattern in the transportation direction of the print medium, and includes the first line segment group and a second line segment group, the second line segment group being formed by the second line segments printed by a given deviation from the center between two adjacent first line segments or the center of the first line segment toward a first side of the direction orthogonal to the transportation direction of the print medium. The second-side deviation pattern is spaced away from the reference pattern in the transportation direction of the print medium opposite to the first-side deviation pattern across the reference pattern, and includes the first line segment group and a second line segment group, the second line segment group being formed by the second line segments printed by a given deviation from the center between the two adjacent first line segments or the center of the first line segment toward a second side of the transportation direction of the print medium. The first-side deviation pattern and the second-side deviation pattern are printed with various deviations.

With the embodiment of the present invention, the first-side deviation pattern and the second-side deviation pattern are printed across the reference pattern. The deviation patterns are printed with various deviations. When the second line segment is printed at the center between the two adjacent first line segments with no skew or serpentine transportation, the whole of the second line segments appears as it is. Consequently, the reference pattern is recognized the darkest in terms of a visual density difference. When the second line segment is printed at the center of the first line segment, the second line segment entirely lays on the first line segment in the reference pattern. Accordingly, the reference pattern is recognized the brightest in terms of the visual density difference. In contrast to this, when the misregister in the transportation direction occurs, the second line segment group is shifted relative to the first line segment group depending on the degree of the skew or serpentine transportation. Accordingly, the visual density difference changes, and the dark or bright pattern is shifted from the reference pattern to the first-side deviation pattern or the second-side deviation pattern. Consequently, a given deviation in the deviation pattern to be dark or bright corresponds to a correction amount. Accordingly, a correction value resulting from the misregister in the transportation direction is obtainable from the correction amount. As a result, the correction amount for correcting the misregister in the transportation direction is obtainable simply and rapidly.

Moreover, the first line width is preferably set larger than the second line width in the embodiments of the present invention.

The second line segment is so shifted largely as to be laid on the first line segment entirely. This achieves an increased visual density difference, causing easy recognition of the dark or bright deviation pattern.

Moreover, the first line segment is preferably set shorter than the second line segment in the embodiments of the present invention.

Accordingly, the second line segment is so printed as to protrude from the first line segment. Consequently, a given deviation at the protrusion portion is readily recognized visually.

Moreover, the second line width is preferably set smaller than the first given interval in the embodiments of the present invention.

This achieves an increased area of the print medium in a ground color, and accordingly an increased visual density difference, leading to ready recognition of the bright or dark pattern.

Moreover, another embodiment of the present invention discloses a printing apparatus for performing printing to a print medium. The printing apparatus includes a transportation device transporting the print medium, a plurality of printing heads spaced away from one another in a transportation direction of the print medium and printing an image on the print medium; and a control unit. The control unit operates the plurality of printing heads and the transporting device to print an inspecting chart including a reference pattern containing a first line segment group and a second line segment group, a first-side deviation pattern, and a second-side deviation pattern. The first line segment group is formed by a plurality of first line segments printed by a reference printing head on the print medium at a first given interval, the first line segments each having a first line width parallel to a transportation direction of the print medium. The second line segment is formed by second line segments printed by a printing head on a center between two adjacent first line segments or a center of each of the first line segments, the printing head being spaced away from the reference printing head in the transportation direction of the print medium, and the second line segments each having a second line width and being parallel to the first line segments. The first-side deviation pattern is spaced away from the reference pattern in a direction orthogonal to the transportation direction of the print medium, and includes the first line segment group and a second line segment group, the second line segment group being formed by the second line segments printed by a given deviation from the center between the two adjacent first line segments or the center of each of the first line segments toward a first side of the direction orthogonal to the transportation direction of the print medium. The second-side deviation pattern is spaced away from the reference pattern in the direction orthogonal to the transportation direction of the print medium opposite to the first-side deviation pattern across the reference pattern, and includes the first line segment group and a second line segment group, the second line segment group being formed by the second line segments printed by a given deviation from the center between the two adjacent first line segments or the center of each of the first line segments toward a second side of the direction orthogonal to the transportation direction of the print medium. The first-side deviation pattern and the second-side deviation pattern are printed with various deviations.

With the embodiment of the present invention, the control unit operates the printing heads while the transporting device transports the print medium to print the inspecting chart containing the reference pattern, the first-side deviation pattern, and the second-side deviation pattern with various deviations. When the skew or serpentine transportation occurs, the visual density difference changes, and the dark or bright pattern is shifted from the reference pattern to the first-side deviation pattern or the second-side deviation pattern. Consequently, a given deviation in the deviation pattern to be dark or bright corresponds to a correction amount. Accordingly, a correction value resulting from the skew or serpentine transportation is obtainable from the correction amount. As a result, the correction amount for correcting misregister due to the skew or serpentine transportation is obtainable simply and rapidly.

Moreover, another embodiment of the present invention discloses a printing apparatus for performing printing to a print medium. The printing apparatus includes a transportation device transporting the print medium, a plurality of printing heads spaced away from one another in a transportation direction of the print medium and printing an image on the print medium, and a control unit. The control unit operates the plurality of printing heads and the transporting device to print an inspecting chart including a reference pattern containing a first line segment group and a second line segment group, a first-side deviation pattern, and a second-side deviation pattern. The first line segment group is formed by a plurality of first line segments printed by a reference printing head on the print medium at a first given interval, the first line segments each having a first line width orthogonal to a transportation direction of the print medium. The second line segment is formed by second line segments printed by a printing head on a center between two adjacent first line segments or a center of each of the first line segments, the printing head being spaced away from the reference printing head in the transportation direction of the print medium, and the second line segments each having a second line width and being parallel to the first line segments. The first-side deviation pattern is spaced away from the reference pattern in the transportation direction of the print medium, and includes the first line segment group and a second line segment group, the second line segment group being formed by the second line segments printed by a given deviation from the center between the two adjacent first line segments or the center of each of the first line segments toward a first side of the direction orthogonal to the transportation direction of the print medium. The second-side deviation pattern is spaced away from the reference pattern in the transportation direction of the print medium opposite to the first-side deviation pattern across the reference pattern, and includes the first line segment group and a second line segment group, the second line segment group being formed by the second line segments printed by a given deviation from the center between the two adjacent first line segments or the center of each of the first line segments toward a second side of the transportation direction of the print medium. The first-side deviation pattern and the second-side deviation pattern are printed with various deviations.

With the embodiment of the present invention, the control unit operates the printing heads while the transporting device transports the print medium to print the inspecting chart containing the reference pattern, the first-side deviation pattern, and the second-side deviation pattern with various deviations. When the misregister in the transportation direction occurs, the visual density difference changes, and the dark or bright pattern is shifted from the reference pattern to the first-side deviation pattern or the second-side deviation pattern. Consequently, a given deviation in the deviation pattern to be dark or bright corresponds to a correction amount. Accordingly, a correction value resulting from the misregister in the transportation direction is obtainable from the correction amount. As a result, the correction amount for correcting misregister in the transportation direction is obtainable simply and rapidly.

It is to be understood that both the foregoing general description and the following detailed description are exemplary and explanatory and are intended to provide further explanation of the invention as claimed.

BRIEF DESCRIPTION OF DRAWINGS

For the purpose of illustrating the invention, there are shown in the drawings several forms which are presently preferred, it being understood, however, that the invention is not limited to the precise arrangement and instrumentalities shown.

DESCRIPTION OF EMBODIMENTS

Figure 1:
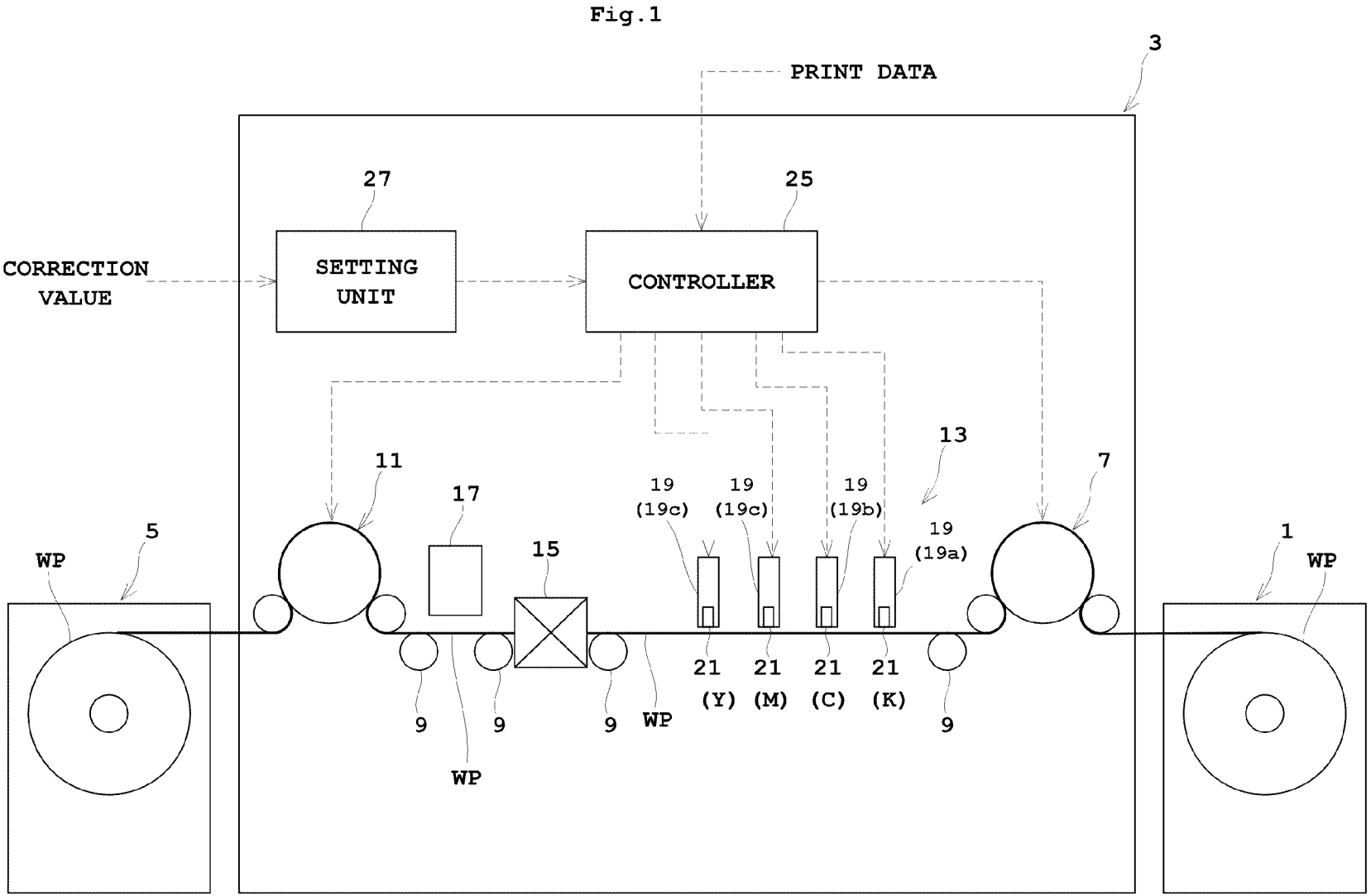
FIG. 1 is a schematic view illustrating an entire inkjet printing system according to one embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

The following describes embodiments of the present invention with reference to the drawings.

Figure 2:
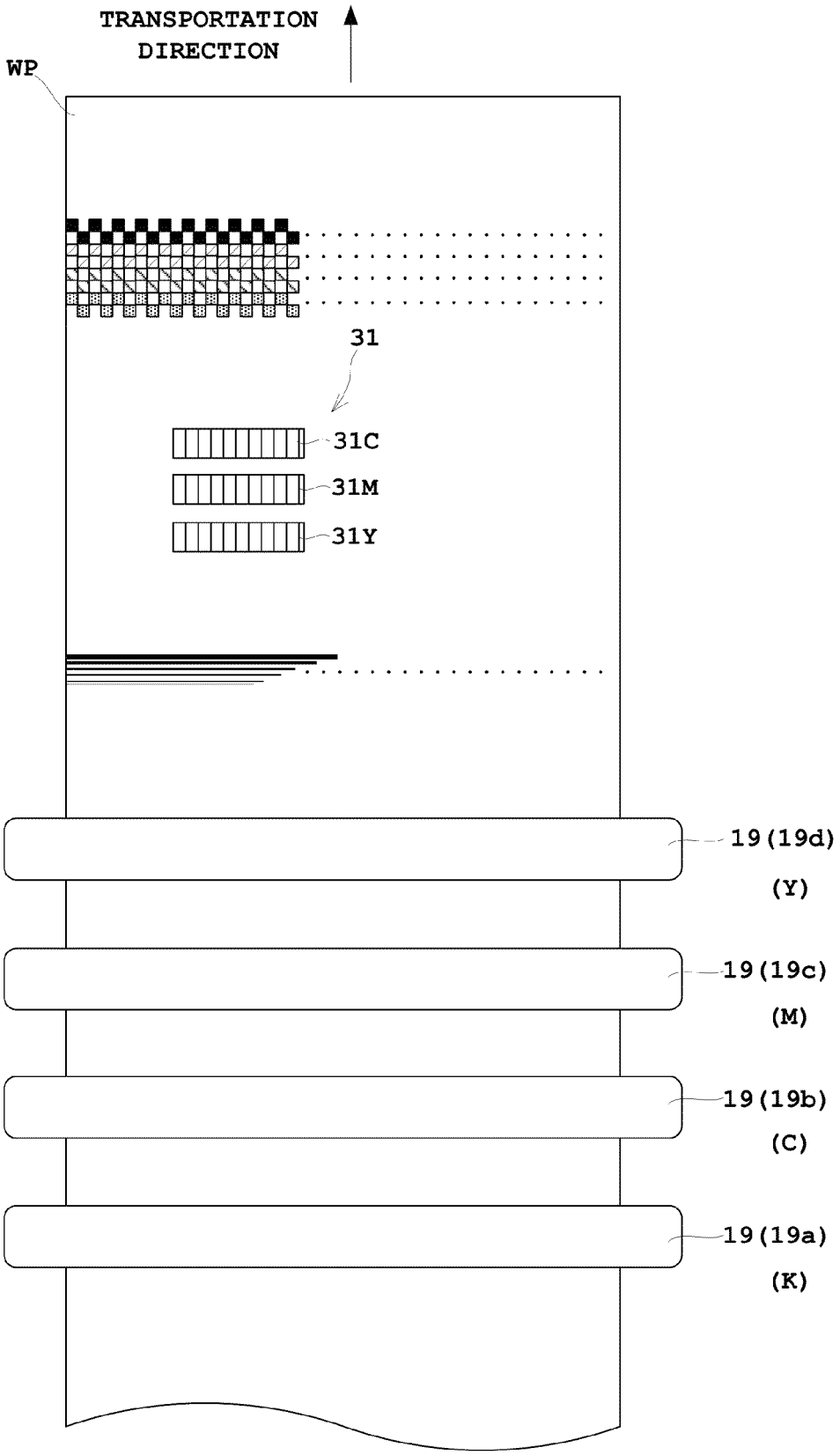
FIG. 2 is a schematic view illustrating a position relationship in a plan view between web paper and each of printing heads.

FIG. 1 is a schematic view illustrating an entire inkjet printing system according to one embodiment of the present invention. FIG. 2 is a schematic view illustrating a position relationship in a plan view between web paper and each of printing heads.

The inkjet printing system according to one embodiment of the present invention includes a paper feeder 1, an inkjet printing apparatus 3, and a take-up roller 5.

The paper feeder 1 holds the web paper WP in a roll form to be rotatable about a horizontal axis. The paper feeder 1 unwinds the web paper WP to feed the paper to the inkjet printing apparatus 3. The take-up roller 5 winds up the web paper WP printed by the inkjet printing device 3 about a horizontal axis. Regarding the side from which the web paper WP is fed as upstream and the side to which the web paper WP is discharged as downstream, the paper feeder 1 is disposed upstream of the inkjet printing apparatus 3, whereas the take-up roller 5 is disposed downstream of the inkjet printing apparatus 3.

The inkjet printing apparatus 3 includes a drive roller 7 in an upstream position thereof for taking in the web paper WP from the paper feeder 1. The web paper WP unwound from the paper feeder 1 by the drive roller 7 is transported downstream toward the take-up roller 5 along a plurality of transport rollers 9. A drive roller 11 is disposed between the most downstream transport roller 9 and the take-up roller 5. The drive roller 11 feeds the web paper WP travelling on the transport rollers 9 toward the take-up roller 5.

The inkjet printing apparatus 3 above corresponds to the "printing apparatus" in the present invention. The drive rollers 7, 11 and the transport rollers 9 correspond to the "transporting device" in the present invention. The web paper WP corresponds to the "print medium" in the present invention.

Between the drive roller 7 and drive roller 11, the inkjet printing apparatus 3 has a printing unit 13, a drying unit 15, and an inspecting unit 17 arranged in this order from upstream. The drier 15 dries portions printed by the printing unit 13. The inspecting unit 17 inspects the printed portions for any stains or omissions.

The printing unit 13 has a plurality of printing heads 19 for discharging ink droplets. For instance, this embodiment includes four printing heads 19. Here, each printing head 19 is formed by printing heads 19*a*, 19*b*, 19*c*, and 19*d* in this order from upstream toward downstream. In this specification, when the printing head 19 should be identified individually, an alphabetical numeral (e.g., a) is applied to the numeral 19. Otherwise, only the numeral 19 is indicated. The printing heads 19 each have a plurality of inkjet nozzles 21*a* for discharging ink droplets. A plurality of inkjet nozzles 21 is arranged in the transportation direction of the web paper WP and in an orthogonal direction to the transportation direction of the web paper WP. The printing heads 19*a* to 19*d* discharge ink droplets in at least two colors, and allows multi-color printing on the web paper WP. For instance, the printing head 19*a* discharges ink droplets in black (K), the printing head 19*b* discharges ink droplets in cyan (C), printing head 19*c* discharges ink droplets in magenta (M), and the printing head 19*d* discharges ink droplets in yellow (Y). The printing heads 19*a* to 19*d* are each spaced away from one another at given intervals in the transportation direction.

A controller 25 includes a CPU and a memory not shown. The controller 25 receives print data from an external computer, not shown, and converts the print data into print-processing data. Thereafter, the controller 25 operates the drive rollers 7 and 11 to transport the web paper WP while the printing heads 19 discharge ink droplets in accordance with the print-processing data, whereby an image based on the print data is printed on the web paper WP. The controller 25 stores in advance the print-processing data on the inspecting chart for detecting the skew or serpentine transportation of the web paper WP or unevenness in the transportation direction. When an operator of the inkjet printing system issues a command to print the inspecting chart, the controller 25 reads the print-processing data for the inspecting chart, and operates the drive rollers 7, 11 and the printing head 19 to print the inspecting chart on the web paper WP.

An operator operates a setting unit 27 to issue a command about printing to the controller 25. Specifically, as illustrated in FIG. 2, the setting unit 27 sets correction values determined from the inspecting chart 31 (31C, 31M, and 31Y). The correction value is used for correcting misregister due to the skew or serpentine transportation. The inspecting chart 31 includes inspecting charts 31C, 31M, and 31Y for correction in reference to the uppermost printing head 19*a*. The inspecting chart 31C is used for correcting the misregister of the printing head 19*b*, the inspecting chart 31M for correcting the misregister of the printing head 19*c*, and the inspecting chart 31Y is used for correcting the misregister of the printing head 19*a*.

Here, the printing head 19*a* correspond to the "reference printing head" in the present invention.

Figure 3:
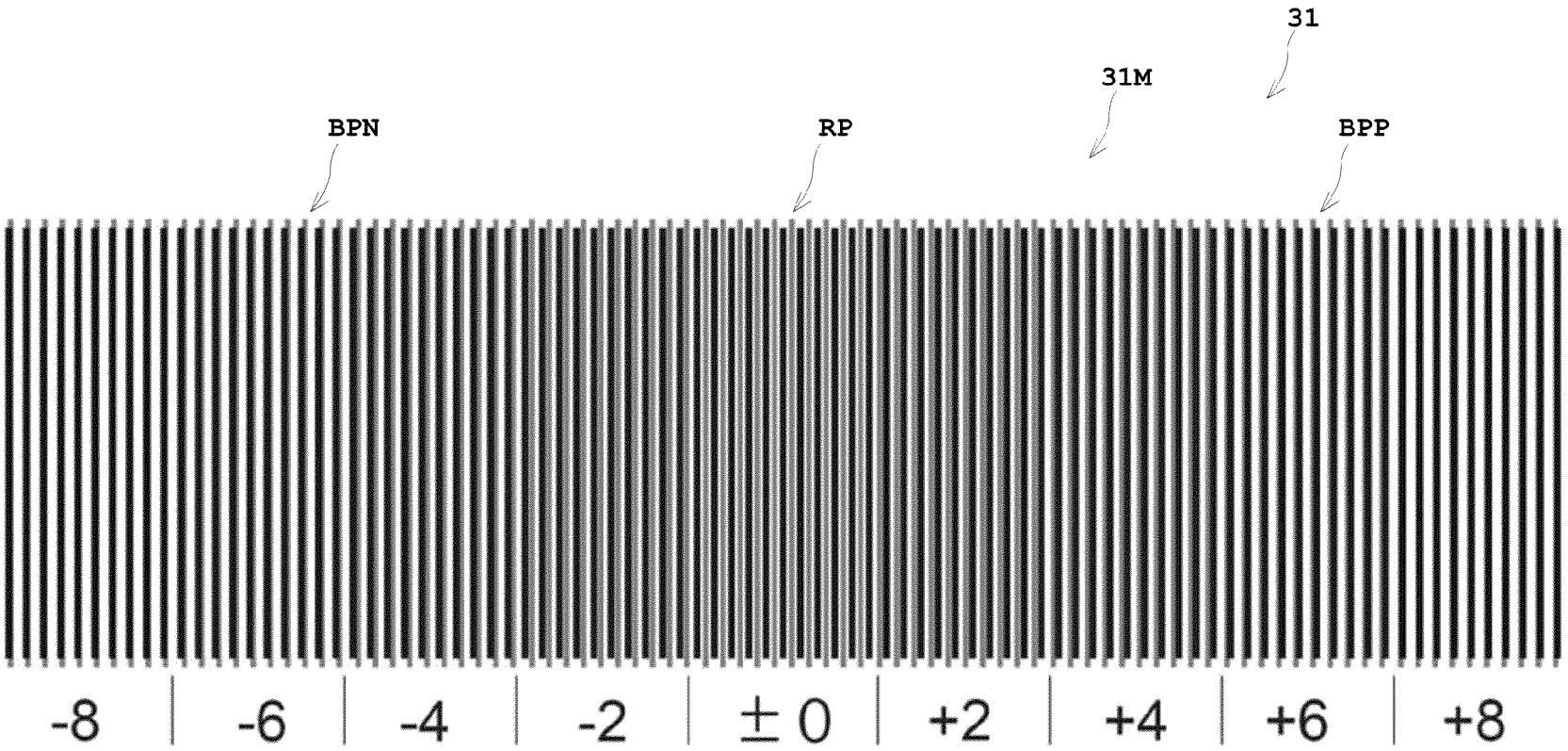
FIG. 3 illustrates an enlarged inspecting chart.
Figure 4:
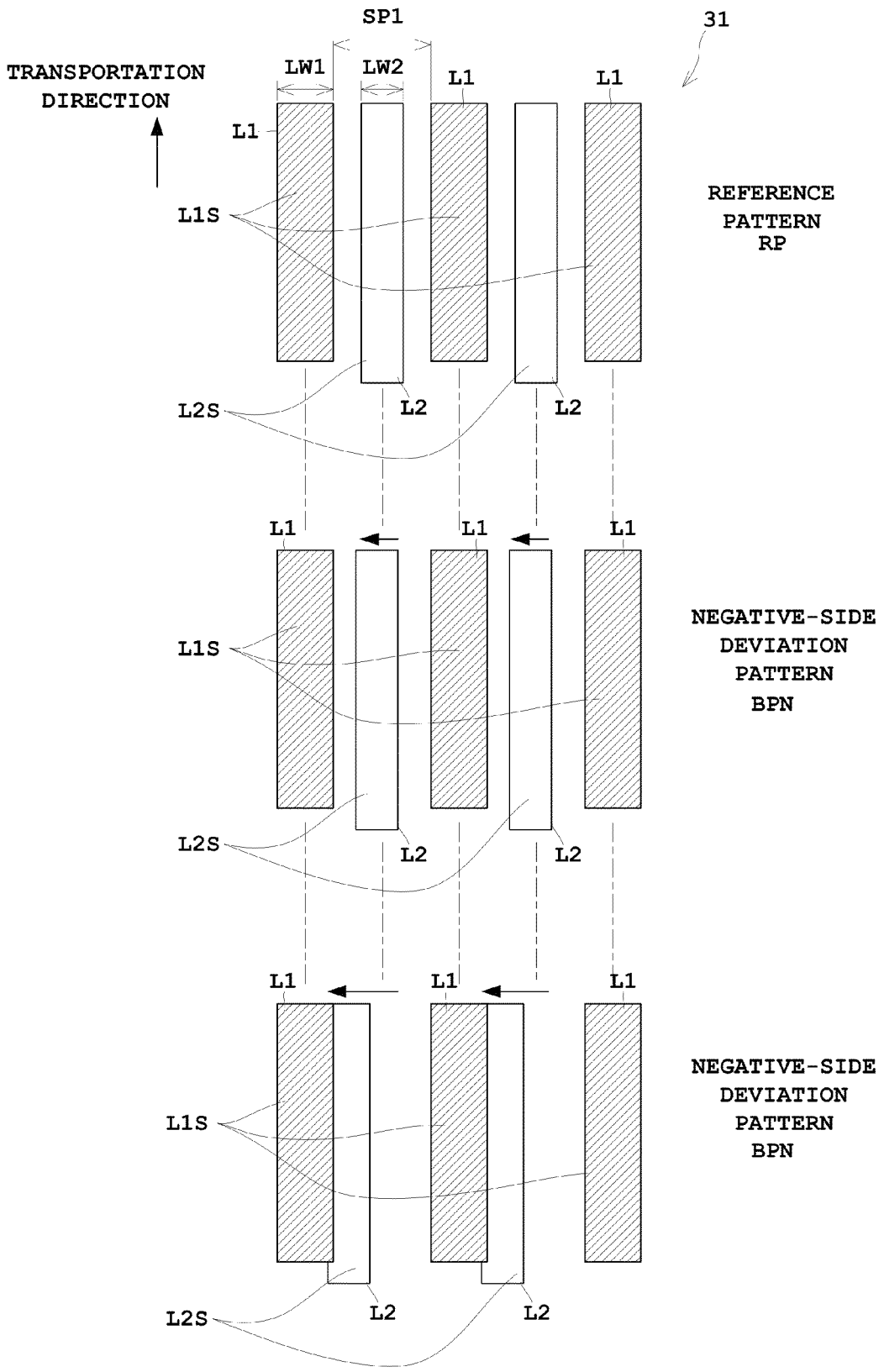
FIGS. 4 and 5 are schematic views each illustrating a partially-enlarged inspecting chart for explanation of a positional relationship.
Figure 5:
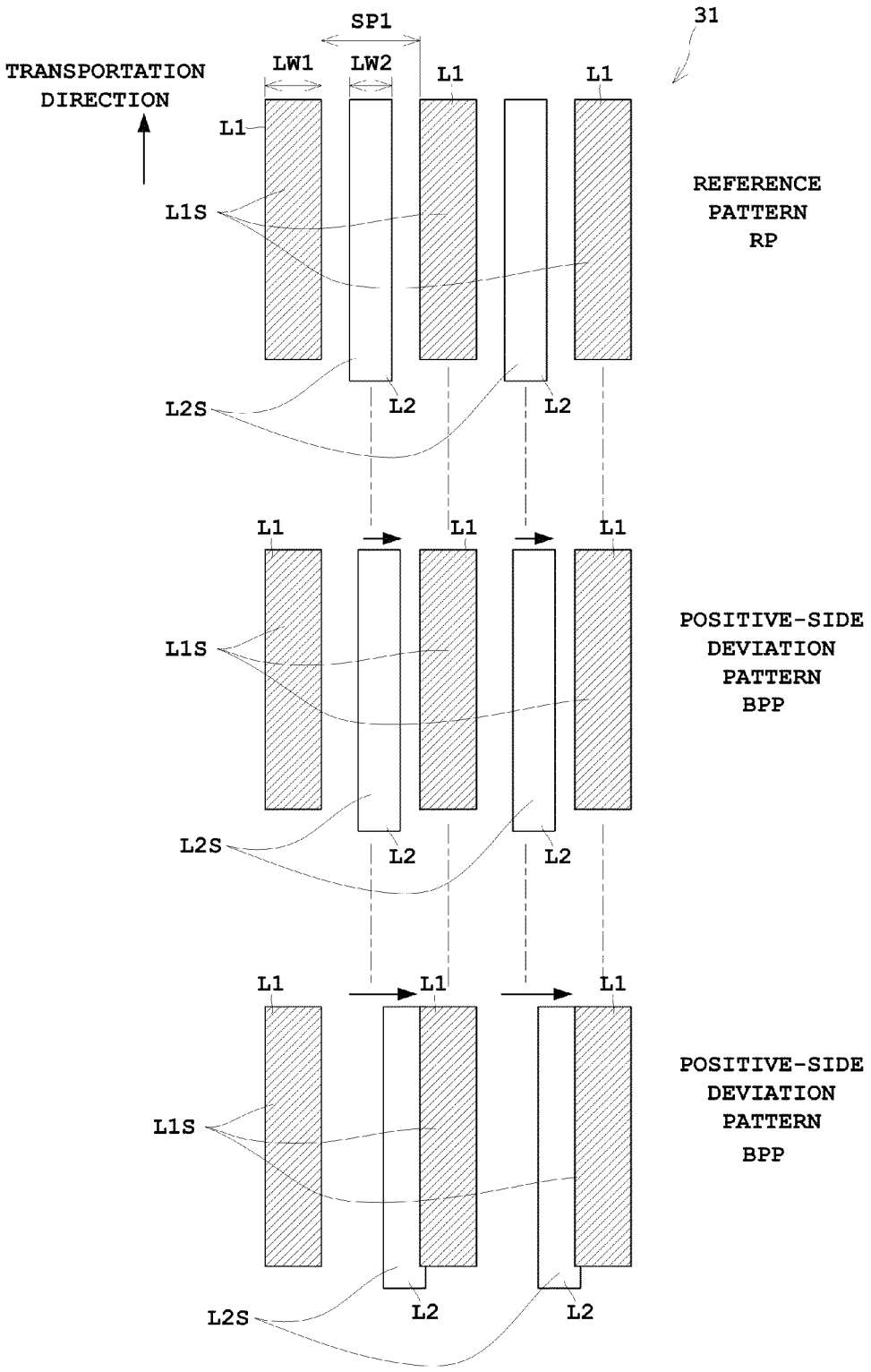

The following describes the inspecting chart with reference to FIGS. 3 to 5. FIG. 3 is an example of an enlarged inspecting chart. FIGS. 4 and 5 are schematic views each illustrating a partially-enlarged inspecting chart for explanation of a positional relationship. In FIGS. 4 and 5, a reference pattern and deviation patterns are arranged vertically for convenience of comparison.

FIG. 3 is an example of the inspecting chart 31M for correcting the misregister of the printing head 19*c* relative to the printing head 19*a*. The inspecting chart 31M contains numerical numbers at the bottom thereof. The numbers each represent a correction value.

The inspecting chart 31 includes a reference pattern RP at the center, a negative-side deviation pattern BPN on the left of the reference pattern RP, and a positive-side deviation pattern BPP on the right of the reference pattern.

Firstly, the reference pattern RP is described with reference to FIGS. 4 and 5. The reference pattern RP includes a first line segment group L1S containing a plurality of first line segments L1 printed with the printing head 19*a* at a given first interval SP1. The first line segments L1 each have a first line width LW1 parallel to the transportation direction of the web paper WP. Only needed is the number of first line segment groups L1S sufficient for achieving generation of a visual density difference. The reference pattern RP further includes a second line segment group L2S containing second line segments L2 that are each printed between the two adjacent first line segments L1 with the printing head 19, such as the printing head 19*c*, spaced away from the printing head 19*a*. The second line segments L2 are each parallel to the first line segment L1 and each have a second line width LW2.

The following describes the negative-side deviation pattern BPN with reference to FIG. 4. As illustrated in FIG. 3, the negative-side deviation pattern BPN is spaced away from the reference pattern RP leftward of a direction orthogonal to the transportation direction of the web paper WP. The negative-side deviation pattern BPN contains a first line segment group L1S formed by the first line segments L1 identical to those of the reference pattern RP, and a second line segment group L2S formed by printing the second line segments L2 of the reference pattern RP so as to be shifted from the center of the first line segments L1 leftward of the direction orthogonal to the transportation direction of the web paper WP by a given deviation (e.g., two dots). The negative-side deviation pattern BPN is further printed while the deviation thereof is gradually increased. In this embodiment, four negative-side deviation patterns BPN are printed.

The following describes the positive-side deviation pattern BPP with reference to FIG. 5. As illustrated in FIG. 3, the positive-side deviation pattern BPP is spaced away from the reference pattern RP rightward of the direction orthogonal to the transportation direction of the web paper WP. The positive-side deviation pattern BPP contains a first line segment group L1S formed by the first line segments L1 identical to those of the reference pattern RP, and a second line segment group L2S formed by printing the second line segments L2 of the reference pattern RP so as to be shifted from the center of the first line segments L1 rightward of the direction orthogonal to the transportation direction of the web paper WP by a given deviation (e.g., two dots). The positive-side deviation pattern BPP is further printed while the deviation thereof is gradually increased. In this embodiment, four positive-side deviation patterns BPP are printed.

The inspecting chart 31 in this embodiment includes the reference pattern RP at the center thereof, the four negative-side deviation patterns BPN on the left, and the four positive-side deviation patterns BPP on the right. As mentioned above, the deviation patterns BPN and BPP each have the second line segment group L2S shifted relative to the reference pattern RP. This causes the visual density difference. That is, when no skew or serpentine transportation occurs, the whole of the second line segment group L2S appears as it is in the reference pattern RP. Consequently, the reference pattern RP is recognized the darkest in terms of on a visual density difference. The skew or serpentine transportation occurs, the second line segment group L2S is shifted, and accordingly a portion recognized dark in terms of the visual density difference is shifted. A deviation amount of the portion recognized dark corresponds to a correction value of the misregister due to the skew or serpentine transportation.

As mentioned above, the first line width LW1 is set larger than second line width LW2. Consequently, the second line segment L2 is so shifted largely as to be laid on the first line segment L1 entirely. This achieves an increased visual density difference, causing ready recognition of the dark or bright deviation pattern.

Moreover, the first line segment L1 is set shorter than the second line segment L2. Accordingly, the second line segment L2 is so printed as to protrude from the first line segment L1. Consequently, a given deviation at the protrusion portion is readily recognized visually.

Moreover, the second line width LW2 is smaller than the first given interval SP1. This achieves an increased area of the print medium in a ground color, and accordingly an increased visual density difference, leading to ready recognition of the bright or dark pattern.

Figure 6:
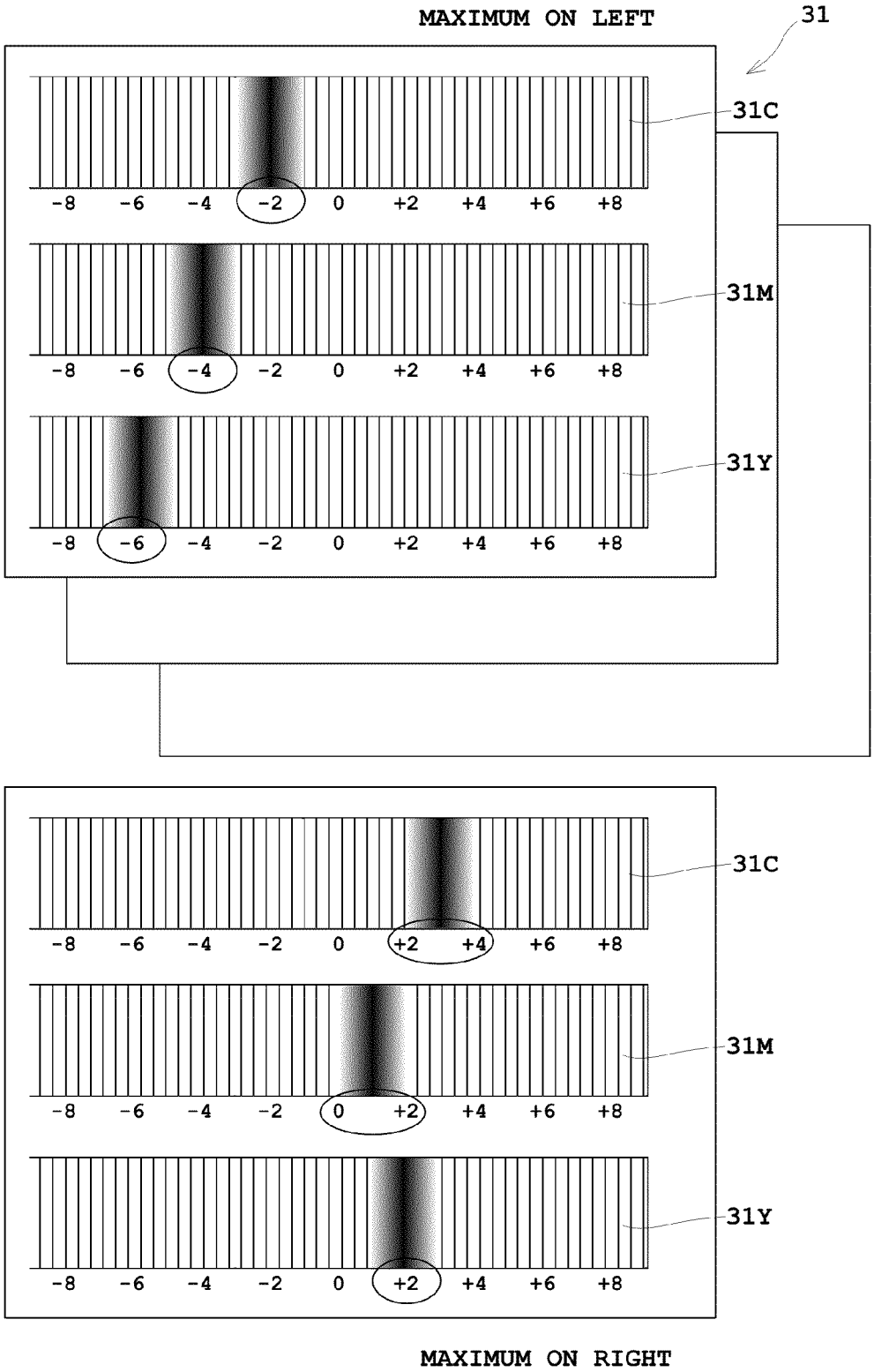
FIG. 6 is a schematic view of one example of the inspecting chart when skew or serpentine transportation occurs.

The following describes actual determination of the correction value with reference to FIG. 6. FIG. 6 is a schematic view illustrating one example of the inspecting chart when the skew or serpentine transportation occurs.

The misregister occurs from the skew or the serpentine transportation, and thus involves some fluctuations. Then, a plurality of inspecting charts 31 is printed. Among them, an inspecting chart 31 shifted largest to the negative-side (leftward) and an inspecting chart 31 shifted largest to the positive-side (rightward) are selected based on the darkest in the visual density difference. Here, as illustrated in FIG. 6, an inspecting chart 31C has the maximum deviation of −2 on the negative-side (on the left), an inspecting chart 31M has the maximum deviation of −4, and an inspecting chart 31Y has the maximum deviation of −6. Moreover, an inspecting chart 31C has the maximum deviation of +3 on the positive-side (on the right), an inspecting chart 31M has maximum deviation of +1, and an inspecting chart 31Y has maximum deviation of +2.

Then the following describes determination of correction amounts in the printing head 19*b* (for printing in cyan C). It is assumed here that the above inkjet printing apparatus 3 has a resolution of 1200 by 1200 dpi and a gap between pixels is approximately 20 μm.

The above inspecting chart 31C has the maximum correction value of −2 on the negative-side (on the left) and the maximum correction value +3 on the positive-side (on the right). Consequently, a correction amount is given by the following equation:

A correction amount (pixel)=the maximum correction value on the negative side−(the maximum correction value on the a negative side−the maximum correction value on the positive side)/2

Specifically, a correction amount is given by 2−(−2−(+3))/2=+0.5 pixel. Taking into consideration that correction can be made to each of the inkjet nozzles 21, a correction amount is approximately 1 pixel. Then the correction amount is set to the setting unit 27. The controller 27 controls printing with the printing head 19*b* (for cyan) to shift the printing by 1 dot rightward from a position printed with printing-processing data.

In this embodiment, the negative-side deviation pattern BPN and the positive-side deviation pattern BPP are printed across the reference pattern RP, with the deviation patterns BPN and BPP each having different deviations. When no skew or serpentine transportation occurs, the whole of the second line segment group L2S appears as it is in the reference pattern RP. Consequently, the reference pattern RP is recognized the darkest in terms of on a visual density difference. In contrast to this, with the skew or serpentine transportation, the second line segment group L2S is shifted relative to the first line segment group L1S depending on the degree of the skew or serpentine transportation. Accordingly, the visual density difference changes, and the dark or bright pattern is shifted from the reference pattern RP to the negative-side deviation pattern BPN or the positive-side deviation pattern BPP. Consequently, a given deviation in the deviation pattern BPN or BPP to be dark corresponds to a correction amount. Accordingly, a correction value resulting from the skew or serpentine transportation is obtainable from the correction amount. As a result, the correction amount for correcting the misregister due to the skew or serpentine transportation is obtainable simply and rapidly.

The inspecting chart 31 includes the second line segment L2 between the two adjacent first line segments L1. Alternatively, an inspecting chart 31A as illustrated in FIG. 7 is adoptable.

That is, a reference pattern RP includes a first line segment group L1S containing a plurality of first line segments L1 printed with the printing head 19*a* at a given first interval SP1. The first line segments L1 each have a first line width LW1 parallel to the transportation direction of the web paper WP. The reference pattern RP further includes a second line segment group L2S containing second line segments L2 printed with the printing head 19, such as the printing head 19*c*, spaced away from the printing head 19*a*. The second line segments L2 each have a second line width LW2 parallel to the first line segment L1 and are each located at the center of the first line segment L1.

The negative-side deviation pattern BPN is spaced away from the reference pattern RP leftward of direction orthogonal to the transportation direction of the web paper WP. The negative-side deviation pattern BPN contains a first line segment group L1S formed by the first line segments L1 identical to those of the reference pattern RP, and a second line segment group L2S formed by printing the second line segments L2 of the reference pattern RP so as to be shifted from the center of the first line segments L1 leftward of the direction orthogonal to the transportation direction of the web paper WP by a given deviation (e.g., 2 dots). The negative-side deviation pattern BPN is further printed while the deviation thereof is gradually increased.

Figure 7:
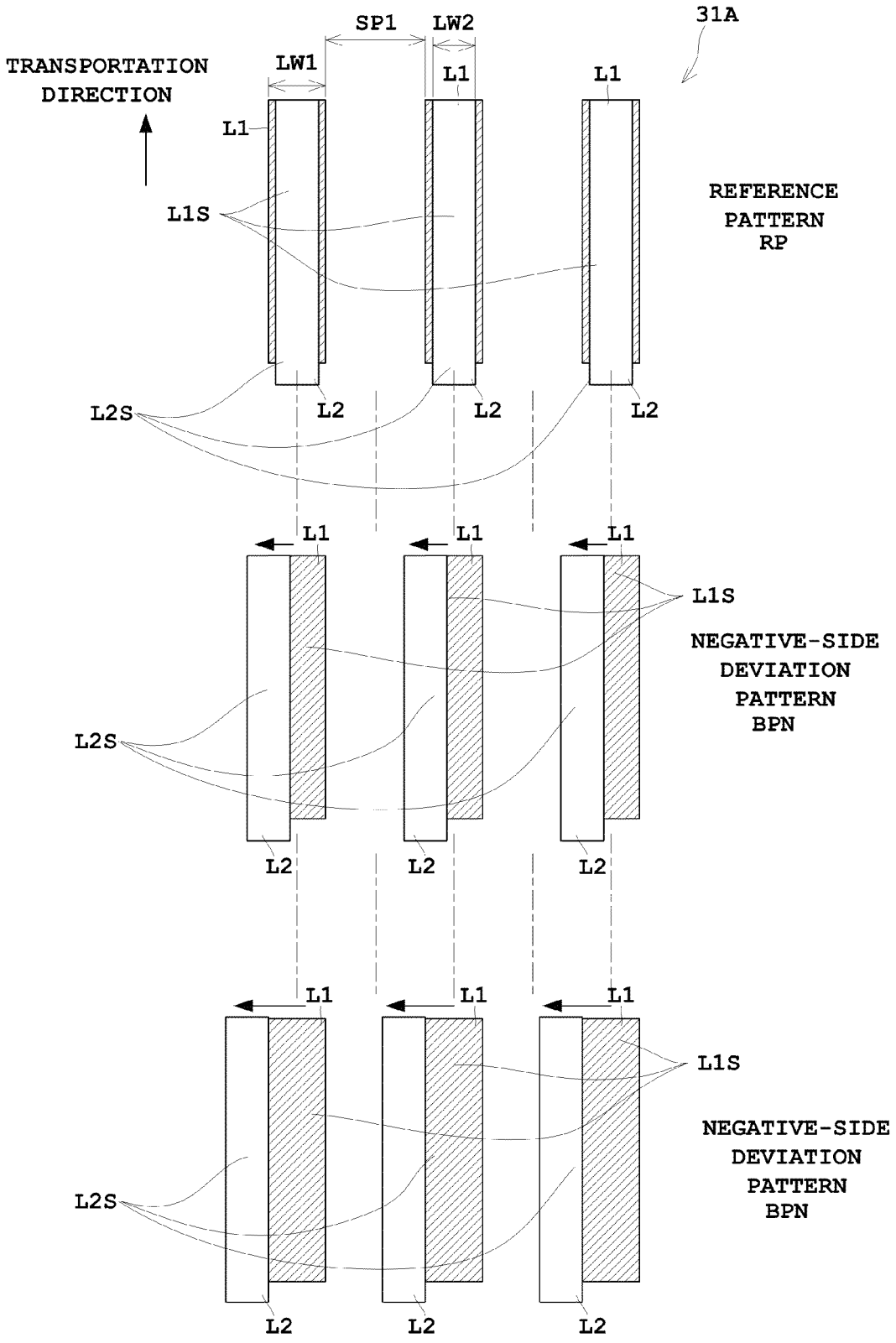
FIG. 7 is a schematic view illustrating another partially-enlarged inspecting chart for explanation of a position relationship.

Here in FIG. 7, a positive-side deviation pattern BPP is not shown. However, similar to the negative-side deviation pattern BPN, the positive-side deviation pattern BPP contains a second line segment group L2S formed by printing the second line segments L2 of the reference pattern RP so as to be shifted from the center of the first line segments L1 rightward of the direction orthogonal to the transportation direction of the web paper WP.

Figure 8:
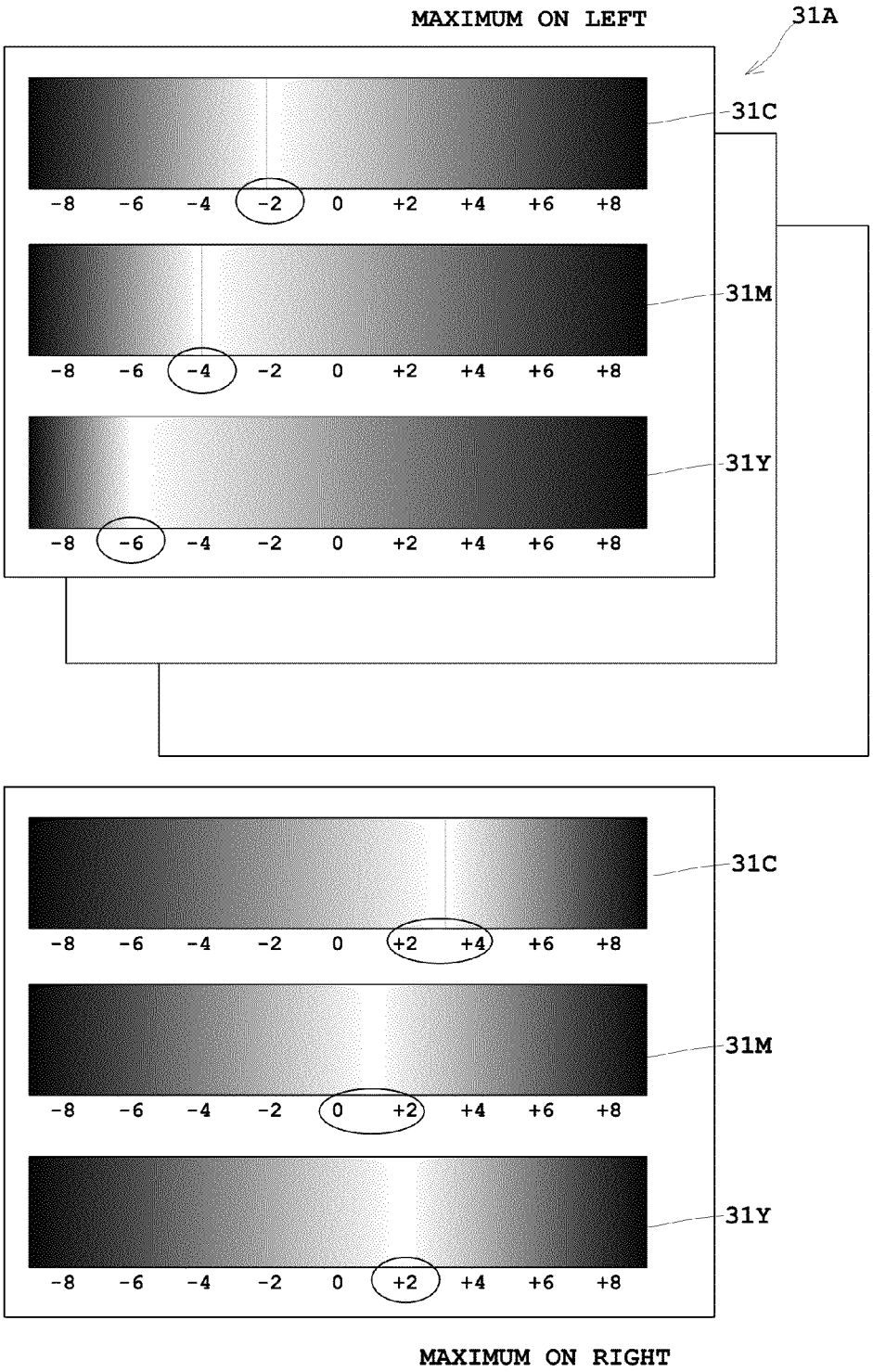
FIG. 8 is a schematic view of one example of the other inspecting chart when skew or serpentine transportation occurs.

When no skew or serpentine transportation occurs, the second line segment L2 entirely lays on the first line segment L1 in the reference pattern RP in such an inspecting chart 31A. Accordingly, the second line segment L2 is recognized the brightest based on the visual density difference. Consequently, given deviations in the deviation patterns BPN and BPP recognized the brightest correspond to correction amounts, as illustrated in FIG. 8.

Figure 9:
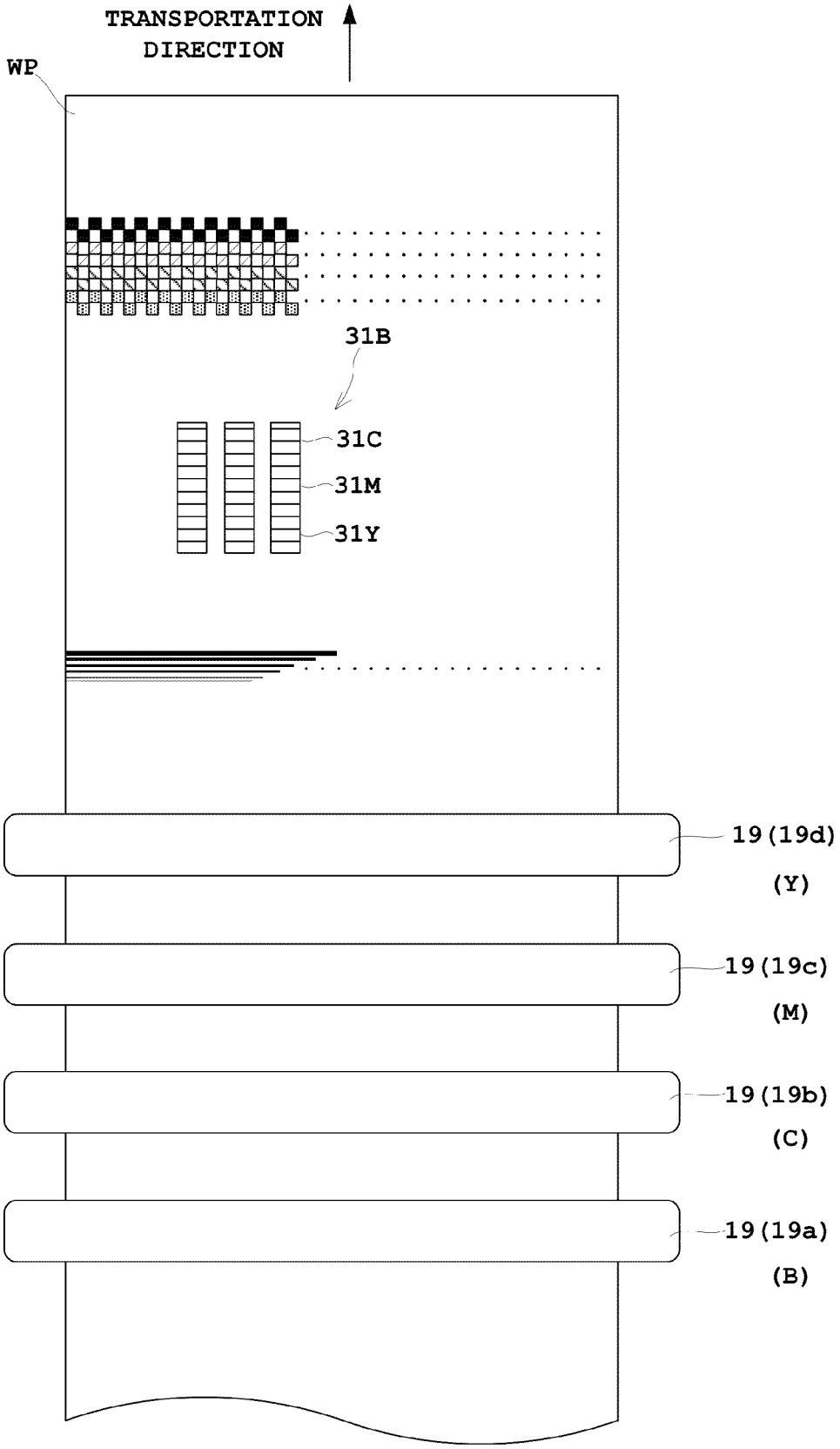
FIG. 9 is a schematic view of an inspecting chart for determining misregister in a transportation direction.

Moreover, in the above embodiment, the correction amount of the misregister due to the skew or serpentine transportation is determined. On the other hand, the embodiment of the present invention including an inspecting chart 31B as illustrated in FIG. 9 achieves obtainment of a correction amount of the misregister in the transportation direction (i.e., transportation unevenness or deviation in discharge timing of the recording head).

The inspecting chart 31B, not shown, corresponds to one obtained by turning the inspecting chart in FIGS. 4, 5, and 7 by 90 degrees relative to the transportation direction.

Specifically, the inspecting chart 31B includes a reference pattern RP. The reference pattern RP includes a first line segment group L1S a second line segment group L2S. The first line segment group L1S contains a plurality of first line segments L1 printed with the printing head 19*a* at a given first interval SP1. The first line segments L1 each have a first line width LW1 orthogonal to a transportation direction of the web paper WP. The second line segment group L2S contains second line segments L2 printed with the printing head 19 spaced away from the printing head 19*a* in the transportation direction of the web paper WP. The second line segments L2 each have a second line width LW2 and are parallel to the first line segment L1. The second line segments L2 are each printed on a center between the two adjacent first line segments L1 or the center of the first line segment L1. The inspecting chart 31B further includes a negative-side (leftward) deviation pattern BPN and a positive-side (rightward) deviation pattern BPP. The negative-side deviation pattern BPN is spaced away from the reference pattern RP in the transportation direction of the web paper WP, and contains a first line segment group L1S, and a second line segment group L2S formed by printing the second line segments L2 of the reference pattern RP so as to be shifted from the center of the first line segments L1 to a negative side (leftward) of the transportation direction of the web paper WP by a given deviation. The positive-side deviation pattern BPP is spaced away from the reference pattern RP in the transportation direction of the web paper WP and in an opposite side of the negative (leftward) deviation pattern across the reference pattern RP. The positive-side deviation pattern BPP contains a first line segment group L1S, and a second line segment group L2S formed by printing the second line segments L2 of the reference pattern RP so as to be shift from the center of the first line segments L1 to a positive side (rightward) of the transportation direction of the web paper WP by a given deviation. The negative-side (leftward) deviation pattern BPP and the positive-side (rightward) deviation pattern BPN are printed with various deviations.

Such an inspecting chart 31B is printed. Then a dark or bright pattern is found to be corrected using an amount equivalent to the deviation. This achieves correction of the misregister in the transportation direction.

The present invention is not limited to the foregoing examples, but may be modified as follows.

(1) The above embodiments describe the web paper WP as one example of the print medium. However, the print medium is not limited to the web paper WP in the present invention. Alternatively, a paper sheet or a film is applicable.

(2) The embodiment mentioned above illustrates an inkjet type printing apparatus. However, a printing apparatus with printing heads spaced away in a paper-feed direction is applicable to the present invention.

(3) In the embodiment mentioned above, the inspecting chart includes the first line segment L1 shorter than the second line segment L2. However, the present invention does not necessarily include such a construction. For instance, the first line segment L1 longer than or same in length as the second line segment L2 is applicable.

(4) The above embodiments adopt the printing head 19*a* as the reference printing head. Alternatively, any of the printing heads 19*b* to 19 may be used as the reference printing head.

The present invention may be embodied in other specific forms without departing from the spirit or essential attributes thereof and, accordingly, reference should be made to the appended claims, rather than to the foregoing specification, as indicating the scope of the invention.

What is claimed is:

1. An inspecting chart for determining a correction value for correcting a skew or serpentine transportation of a print medium, the inspecting chart comprising:

a reference pattern containing a first line segment group and a second line segment group, the first line segment group being formed by a plurality of first line segments printed by a reference printing head on the print medium at a first given interval, the first line segments each having a first line width parallel to a transportation direction of the print medium, the second line segment being formed by second line segments printed by a printing head on a center between two adjacent first line segments or a center of each of the first line segments, the printing head being spaced away from the reference printing head in the transportation direction of the print medium, and the second line segments each having a second line width and being parallel to the first line segments;

a first-side deviation pattern spaced away from the reference pattern in a direction orthogonal to the transportation direction of the print medium, and including the first line segment group and a second line segment group, the second line segment group being formed by the second line segments printed by a given deviation from the center between the two adjacent first line segments or the center of each of the first line segments toward a first side of the direction orthogonal to the transportation direction of the print medium; and a second-side deviation pattern spaced away from the reference pattern in the direction orthogonal to the transportation direction of the print medium opposite to the first-side deviation pattern across the reference pattern, and including the first line segment group and a second line segment group, the second line segment group being formed by the second line segments printed by a given deviation from the center between the two adjacent first line segments or the center of each of the first line segments toward a second side of the direction orthogonal to the transportation direction of the print medium, the first-side deviation pattern and the second-side deviation pattern being printed with various deviations.

2. The inspecting chart according to claim 1, wherein the first line width is set larger than the second line width.

3. The inspecting chart according to claim 2, wherein the second line width is set smaller than the first given interval.

4. The inspecting chart according to claim 1, wherein the first line segment is set shorter than the second line segment.

5. The inspecting chart according to claim 4, wherein the second line width is set smaller than the first given interval.

6. The inspecting chart according to claim 1, wherein the second line width is set smaller than the first given interval.

7. A printing apparatus for performing printing to a print medium, the printing apparatus comprising:

a transportation device transporting the print medium;

a plurality of printing heads spaced away from one another in a transportation direction of the print medium and printing an image on the print medium; and a control unit operating the plurality of printing heads and the transporting device to print an inspecting chart including a reference pattern containing a first line segment group and a second line segment group, a first-side deviation pattern, and a second-side deviation pattern, the first line segment group being formed by a plurality of first line segments printed by a reference printing head on the print medium at a first given interval, the first line segments each having a first line width parallel to a transportation direction of the print medium, the second line segment being formed by second line segments printed by a printing head on a center between two adjacent first line segments or a center of each of the first line segments, the printing head being spaced away from the reference printing head in the transportation direction of the print medium, and the second line segments each having a second line width and being parallel to the first line segments, the first-side deviation pattern being spaced away from the reference pattern in a direction orthogonal to the transportation direction of the print medium, and including the first line segment group and a second line segment group, the second line segment group being formed by the second line segments printed by a given deviation from the center between the two adjacent first line segments or the center of each of the first line segments toward a first side of the direction orthogonal to the transportation direction of the print medium, the second-side deviation pattern being spaced away from the reference pattern in the direction orthogonal to the transportation direction of the print medium opposite to the first-side deviation pattern across the reference pattern, and including the first line segment group and a second line segment group, the second line segment group being formed by the second line segments printed by a given deviation from the center between the two adjacent first line segments or the center of each of the first line segments toward a second side of the direction orthogonal to the transportation direction of the print medium, the first-side deviation pattern and the second-side deviation pattern being printed with various deviations.

8. The printing apparatus according to claim 7, wherein the first line width is set larger than the second line width.

9. The printing apparatus according to claim 7, wherein the first line segment is set shorter than the second line segment.

10. The printing apparatus according to claim 7, wherein the second line width is set smaller than the first given interval.

* * * * *